US011339708B2

(12) United States Patent
Kim et al.

(10) Patent No.: US 11,339,708 B2
(45) Date of Patent: May 24, 2022

(54) SUPERCHARGER INTEGRAL RESONATOR

(71) Applicant: Eaton Intelligent Power Limited, Dublin (IE)

(72) Inventors: Geon-Seok Kim, Novi, MI (US); Andrew Fedewa, Marshall, MI (US); Rodney Glover, St. Clair Shores, MI (US); Jonah Heemstra, Zeeland, MI (US)

(73) Assignee: Eaton Intelligent Power Limited, Dublin (IE)

( * ) Notice: Subject to any disclaimer, the term of this patent is extended or adjusted under 35 U.S.C. 154(b) by 140 days.

(21) Appl. No.: 16/920,511

(22) Filed: Jul. 3, 2020

(65) Prior Publication Data

US 2020/0408139 A1 Dec. 31, 2020

Related U.S. Application Data

(63) Continuation of application No. 15/735,527, filed as application No. PCT/US2016/036795 on Jun. 10, 2016, now abandoned.

(Continued)

(51) Int. Cl.
*F02B 33/38* (2006.01)
*F02M 35/12* (2006.01)

(Continued)

(52) U.S. Cl.
CPC ..... *F02B 33/38* (2013.01); *F02M 35/1216* (2013.01); *F02M 35/1255* (2013.01);

(Continued)

(58) Field of Classification Search
CPC ..... F02B 33/38; F02M 35/1216; F02M 35/1255; F02M 35/1266; F02M 35/1288;

(Continued)

(56) References Cited

U.S. PATENT DOCUMENTS 4,287,962 A 9/1981 Ingard et al.
4,371,053 A 2/1983 Jones (Continued)

FOREIGN PATENT DOCUMENTS

CN 101235773 A 8/2008
CN 101144475 B 9/2010

(Continued)

OTHER PUBLICATIONS

Herrin et al. "Properties and Applications of Microperforated Panels," Sound & Vibration, Jul. 2011, pp. 6-9.

(Continued)

*Primary Examiner* — Jesse S Bogue
(74) *Attorney, Agent, or Firm* — Mei & Mark, LLP

(57) ABSTRACT

A supercharger assembly comprises a housing, a rotor bore with an outer wall, an outlet in an outlet plane, an inlet in an inlet plane perpendicular to the outlet plane, and an outlet divider wall. The supercharger assembly comprises a first recess, a first perforated material covering the first recess, and an outlet resonator. The first recess is separated from the outlet by the outlet divider wall. The first recess is located between the outer wall and the first perforated material.

20 Claims, 9 Drawing Sheets

Related U.S. Application Data

(60) Provisional application No. 62/318,510, filed on Apr. 5, 2016, provisional application No. 62/205,892, filed on Aug. 17, 2015, provisional application No. 62/204,838, filed on Aug. 13, 2015, provisional application No. 62/174,504, filed on Jun. 11, 2015.

(51) Int. Cl.
*F04C 29/06* (2006.01)
*F04C 18/12* (2006.01)

(52) U.S. Cl.
CPC .... *F02M 35/1266* (2013.01); *F02M 35/1288* (2013.01); *F04C 18/126* (2013.01); *F04C 29/061* (2013.01); *F04C 29/063* (2013.01); *F04C 29/068* (2013.01)

(58) Field of Classification Search
CPC .... F04C 18/126; F04C 29/061; F04C 29/063; F04C 29/068
See application file for complete search history.

(56) References Cited

U.S. PATENT DOCUMENTS

| | | | | |
|---|---|---|---|---|
| 5,760,348 | A | 6/1998 | Heuser | |
| 5,902,970 | A | 5/1999 | Ferri | |
| 5,979,598 | A | 11/1999 | Wolf et al. | |
| 6,283,246 | B1 | 9/2001 | Nishikawa | |
| 6,755,278 | B2 | 6/2004 | Huhn et al. | |
| 6,802,388 | B2 | 10/2004 | Wolf et al. | |
| 6,874,486 | B2 | 4/2005 | Prior et al. | |
| 6,983,820 | B2 | 1/2006 | Boast et al. | |
| 7,584,821 | B2 | 9/2009 | Prior et al. | |
| 7,604,467 | B2 | 10/2009 | Prior | |
| 7,631,726 | B2 | 12/2009 | McWilliam et al. | |
| 7,934,581 | B2 * | 5/2011 | Kim | F02M 35/10157 181/250 |
| 7,997,857 | B2 | 8/2011 | Battig et al. | |
| 8,056,543 | B2 | 11/2011 | Prior | |
| 8,142,172 | B2 * | 3/2012 | Forster | F04C 29/061 417/312 |
| 8,316,813 | B2 | 11/2012 | Prior | |
| 8,316,987 | B2 * | 11/2012 | Ishida | F02M 35/1255 181/247 |
| 8,408,357 | B2 | 4/2013 | Cheung | |
| 8,418,804 | B1 | 4/2013 | Hawwa | |
| 8,701,823 | B2 | 4/2014 | Matsushima et al. | |
| 9,057,313 | B2 | 6/2015 | Heeb | |
| 9,366,258 | B2 * | 6/2016 | Suzuki | F04C 29/066 |
| 9,512,834 | B2 * | 12/2016 | Streeter | F04B 39/0083 |
| 9,605,631 | B2 * | 3/2017 | Zirkelbach | F02M 35/1216 |
| 9,683,521 | B2 | 6/2017 | Mahalatkar et al. | |
| 2006/0005798 | A1 | 1/2006 | Chu | |
| 2006/0032700 | A1 | 2/2006 | Vizanko | |
| 2007/0295554 | A1 | 12/2007 | Flucht et al. | |
| 2008/0060622 | A1 | 3/2008 | Prior | |
| 2008/0073145 | A1 | 3/2008 | Nakamura et al. | |
| 2010/0269797 | A1 | 10/2010 | Prior | |
| 2012/0292127 | A1 * | 11/2012 | Teshima | F02M 35/1216 181/224 |
| 2012/0292128 | A1 * | 11/2012 | Keesser | F01N 13/16 181/227 |
| 2013/0291500 | A1 | 11/2013 | Rodabaugh | |
| 2014/0158131 | A1 | 6/2014 | Barton et al. | |
| 2015/0252759 | A1 | 9/2015 | Ostler et al. | |
| 2018/0171865 | A1 * | 6/2018 | Kim | F04C 29/063 |
| 2018/0306191 | A1 * | 10/2018 | Kim | F02B 33/38 |

FOREIGN PATENT DOCUMENTS

| | | | |
|---|---|---|---|
| DE | 102007046204 | A1 | 4/2009 |
| DE | 102010010031 | A1 | 9/2011 |
| JP | 2005/155502 | A | 6/2005 |
| JP | 2012/159020 | A | 8/2012 |

OTHER PUBLICATIONS

International Search Report and Written Opinion for PCT/US2016/036795 dated Sep. 21, 2016, pp. 1-17.

* cited by examiner

SUPERCHARGER INTEGRAL RESONATOR

This is a continuation of U.S. patent application Ser. No. 15/735,527 filed Dec. 11, 2017, which is a National Stage § 371 entry of International Application No. PCT/US2016/036795, filed Jun. 10, 2016, and claims the benefit of U.S. provisional application No. 62/174,504 filed Jun. 11, 2015, U.S. provisional application No. 62/204,838 filed Aug. 13, 2015, U.S. provisional application No. 62/205,892 filed Aug. 17, 2015, and U.S. provisional application No. 62/318,510 filed Apr. 5, 2016, all of which are incorporated herein by reference.

FIELD

This application relates to devices for damping noise, vibration, and harshness (NVH) emitting from a supercharger.

BACKGROUND

Root superchargers generate high levels of air pulsation while they transport air by a series of air compressing and releasing processes. High levels of air pulsation not only cause noise radiation through the supercharger housing but also travel through the supercharger inlet and outlet and causes neighboring components to vibrate and generate break-out noise.

A Roots blower scoops air from a low pressure suction side and moves this air to the high pressure outlet side. When the low pressure air scooped by the Roots supercharger comes in contact with the high pressure outlet side, then a backflow event takes place whereby the high pressure air from the outlet backflows into the supercharger to compress the low pressure air into higher pressure air. Thus the compression of air in the supercharger happens through this backflow event. This also heats up the compressed low pressure air to a higher temperature based on thermodynamic principles. After compression of the air, the blades of the Roots supercharger squeeze the compressed air out of the supercharger into the high pressure outlet side.

Typically, Roots superchargers use hot high pressure air available at the outlet for the backflow event. However, it is possible to cool the Roots compressor by using relatively colder high pressure air available after an intercooler. Backflow can occur in the supercharger or in an adaptor or resonator attached to the supercharger.

The backflow compression at an outlet port can cause high-level air pulsation. Air pulsation can create unwanted noise, vibration, and harshness. This not only creates undesired noise for persons near the supercharger, but it reduces the lifespan of the supercharger.

Many NVH components, such as encapsulation or enhanced material thicknesses on parts such as conduits, are required to meet the customer NVH level specifications. It would be beneficial to reduce the number of components necessary to treat NVH caused by supercharger action in regard to cost and packaging.

SUMMARY

The devices disclosed herein overcome the above disadvantages and improves the art by way of an outlet resonator assembly.

A supercharger assembly comprises a housing, a rotor bore with an outer wall, an outlet in an outlet plane, an inlet in an inlet plane perpendicular to the outlet plane, and an outlet divider wall. The supercharger assembly comprises a first recess, a first perforated material covering the first recess, and an outlet resonator. The first recess is separated from the outlet by the outlet divider wall. The first recess is located between the outer wall and the first perforated material.

An outlet resonator comprises a housing, a perforated guide in the housing, and a first chamber in the housing. The first chamber comprises a first base comprising a first base width and a first base length perpendicular to first base width. The first chamber further comprises a first chamber height perpendicular to the first base width and perpendicular to the first base length.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

It is to be understood that both the foregoing general description and the following detailed description are exemplary and explanatory only and are not restrictive of the claimed invention.

DETAILED DESCRIPTION

Reference will now be made in detail to the examples, which are illustrated in the accompanying drawings. Wherever possible, the same reference numbers will be used throughout the drawings to refer to the same or like parts. Directional references such as "left" and "right" are for ease of reference to the figures.

Figure 1:
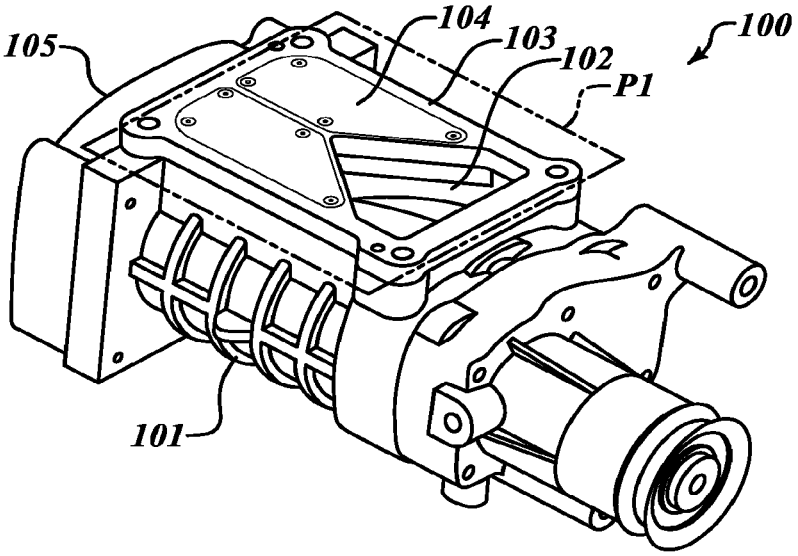
FIG. 1 is a view of a supercharger with micro-perforated panels located parallel to the outlet plane.

FIG. 1 shows a supercharger assembly 100 with a housing 101, an inlet 105, an outlet 102, a spacer 103, and a perforated plate 104. Spacer 103 is located over outlet 102 and parallel to outlet plane P1. Outlet plane P1 is perpendicular to inlet 105. Under the perforated plate 104 is a recess. The spacer 103 can be welded or bolted to the supercharger housing 101. The perforated plate 104 helps to dampen noise during operation.

Figure 2:
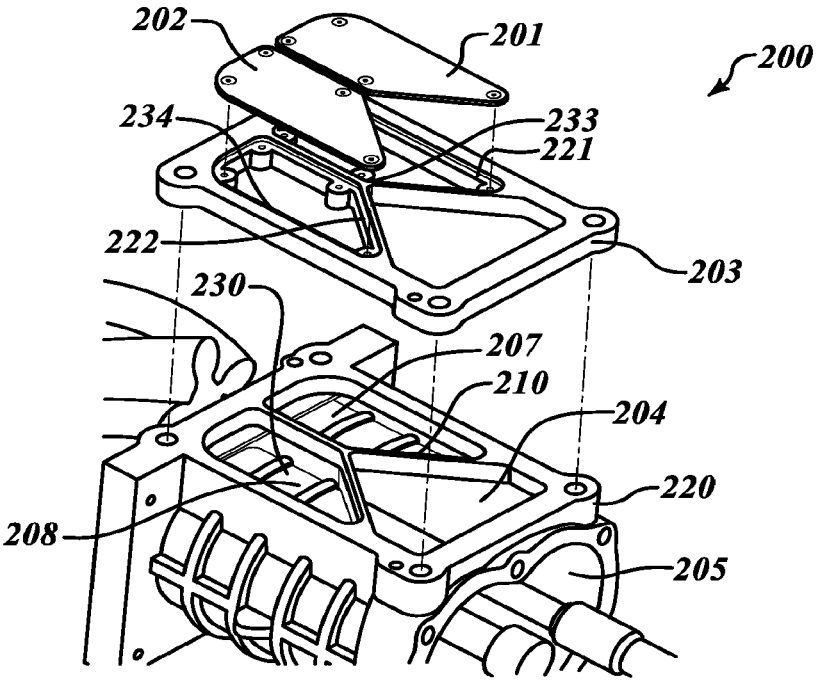
FIG. 2 is an exploded view of a supercharger with micro-perforated panels located parallel to the outlet plane.

FIG. 2 shows an exploded view of a supercharger assembly 200 with a spacer 203 that is connected to a housing 220 over outlet 204. The supercharger assembly 200 can have a rotor bore 205 with an outer wall 230.

Spacer 203 can abut outlet divider wall 210. Outlet divider wall 210 separates outlet 204 from recesses 207, 208. Spacer 203 can have openings 233, 234 aligned over housing recesses 207, 208. Perforated panels 201, 202 can abut steps 221, 222 on spacer 203. Perforated panels 201, 202 can be two separate panels as shown or they can be a single perforated panel covering both spacer recesses 233, 234.

Sound waves and air pulsations that pass through perforated panels 201, 202 toward the outer wall 230 can be damped. The frequency of sound that is damped depends on the porosity of the perforated panels 201, 202 and the distance between the perforated panels 201, 202 and the outer wall 230. One can tune the arrangement to damp a specific frequency or range of frequencies by increasing or decreasing the distance between the perforated panels 201, 202 and the outer wall 230. Outer wall 230 can be flat, curved, or a combination of both.

The examples herein primarily identify sound by its frequency. One could also describe or identify sound by its wavelength. Thus, one can tune the arrangement to damp a certain wavelength in the same manner that one can tune the arrangement to damp a certain frequency. Frequency of sound is inversely proportional to its wavelength, as shown in equation (1).

$$f=c/\lambda \qquad \text{eq. (1)}$$

In equation (1), the variables are defined as follows:

c=speed of sound (m/s);

f=frequency (Hz);

λ=wavelength (m).

Outlet divider wall 210 can prevent fluid from flowing directly from outlet 204 to recesses 207, 208, thereby causing fluid to flow through perforated panels 201, 202 to recesses 207, 208. Likewise, spacer 203 can serve as a barrier between outlet 204 and spacer recesses 233, 234. Turbulent flow generated when the air is released from the supercharger outlet impinges panels 201, 202. Perforated panels 201, 202 can reduce the air pulsation embedded in the turbulent flow. Also, the depth of housing recesses 207, 208 and the thickness of spacer recesses 233, 234 can be selected to damp a certain frequency or wavelength.

Perforated panels 201, 202 can be made of a micro-perforated material. Openings in the perforated panels 201, 202 can be circular with a diameter less than or equal to 1 millimeter. The openings can be the shape of slits, rectangles, crenelated slots, or other shapes. The cross-sectional area of the openings can be less than or equal to 1 square millimeter. The cross-sectional area can be larger, for example, 4 square millimeters. Changing the cross-sectional area can change the frequency of sound and vibration damped by the arrangement. The openings can comprise different shapes and different areas. This can increase the range of frequency damped by the supercharger assembly 200.

For micro-perforated panels with perforations of a circular shape, dimensions can be selected and transfer impedance predicted using equations (2)-(4) below.

Equation 2 can be used to calculate the transfer impedance, where $Z_{tr}$ is the transfer impedance.

$$Z_{tr}=\frac{\Delta p}{\rho c v}=\frac{32\eta t}{\sigma\rho c d^2}\left(\left(1+\frac{\beta^2}{32}\right)^{\frac{1}{2}}+\frac{\sqrt{2}}{8}\beta\frac{d}{t}\right)+ \qquad \text{eq. (2)}$$

-continued $$j\frac{\omega t}{\sigma c}\left(1+\left(3^2+\frac{\beta^2}{32}\right)^{-\frac{1}{2}}+0.85\frac{d}{t}\right)$$

In equation (2), the variables and constants are defined as follows:

d=pore diameter (e.g., diameter of perforations in perforated panel 202);

t=panel thickness (e.g., thickness of perforated panel 202);

η=dynamic viscosity;

σ=porosity;

c=speed of sound;

ρ=density of air;

ω=angular frequency;

Δp=pressure difference.

Equation 3 can be used to calculate beta (β), as follows:

$$\beta=d\sqrt{\omega\rho/4\eta} \qquad \text{eq. (3)}$$

Equation 4 can be used to calculate the transfer impedance (Z) with the backing space. Equation 4 is defined as follows:

$$Z=Z_{tr}-j\cot\frac{\omega D}{c} \qquad \text{eq. (4)}$$

Z=the transfer impedance with the backing space;

D=depth of the recess (e.g., distance from outer wall 230 to perforated panel 202);

j is an imaginary unit, where $j^2=-1$;

cot=cotangent.

Equation 4 can be used to calculate $\alpha_n$—the normal sound absorption coefficient, where $r_n$ and $x_n$ are the real and imaginary parts of the total impedance.

$$\alpha_n=\frac{4r_n}{(1+r_n)^2+x_n^2} \qquad \text{eq. (4)}$$

Spacer 203 allows one to damp frequencies that might otherwise remain undamped. For example, increasing the spacer thickness increases the value of D, the depth of the recess, in equation (4). Thus, one can adjust the damping capability of the arrangement by changing the thickness of spacer 203.

A porous material can be placed below perforated panels 201, 202 in spacer recesses 233, 234 and housing recesses 207, 208. The porous material can be selected to damp a certain frequency or wavelength, for example, a frequency different from the frequency damped by perforated panels 201, 202 positioned over recesses 207, 208.

The porous material can comprise melamine foam, fiberglass, mineral glue, BASOTECT® open cell foam by BASF: The Chemical Company, melamine resin, thermoset polymer, or NOMEX® flame resistant fiber by DuPont.

Figure 3:
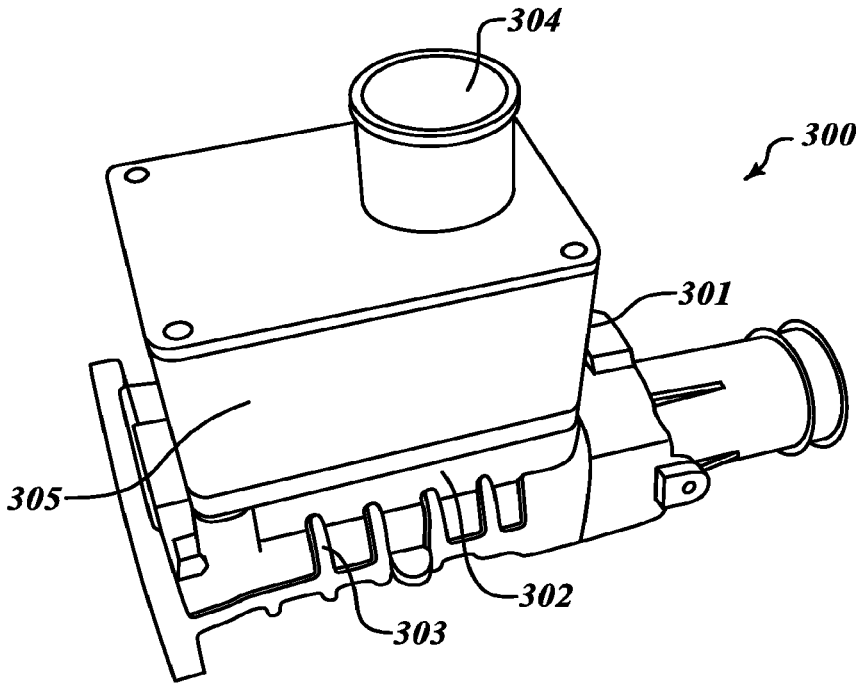
FIG. 3 is a view of an outlet resonator attached to a supercharger.

FIG. 3 shows an example of an outlet resonator 301 attached to the outlet 302 of a supercharger housing 303. The outlet 304 of the outlet resonator 301 can be circular in shape. This allows one to attach the supercharger assembly 300 to a circular hose or port.

Outlet resonator 301 has a housing 305. Inside of this housing are chambers, for example, as shown in FIG. 4A.

Figure 4A:
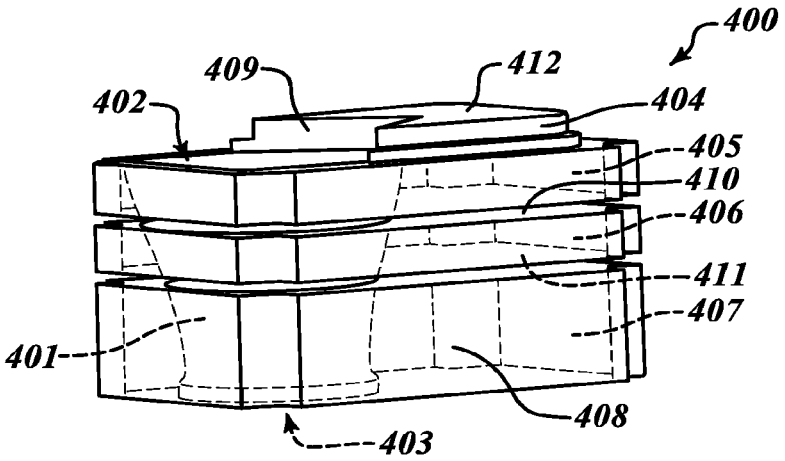
FIG. 4A is a view of an outlet resonator.

FIG. 4A shows an outlet resonator assembly 400 with a guide 401 that transitions from a V-shaped opening at the inlet 402 to a circular-shaped opening at the outlet 403. Outlet resonator assembly 400 includes an extender chamber 404, a first chamber 405, a second chamber 406, and a third chamber 407 in the housing 408.

Fluid can exit a supercharger outlet and flow into inlet 402. The lip 409 of extender 412 can be perforated, allowing fluid to flow into first chamber 404. Fluid can flow through first chamber 404 to a perforated panel positioned over a recess, for example, to perforated panels 201, 202 as shown in FIG. 2.

Figure 4B:
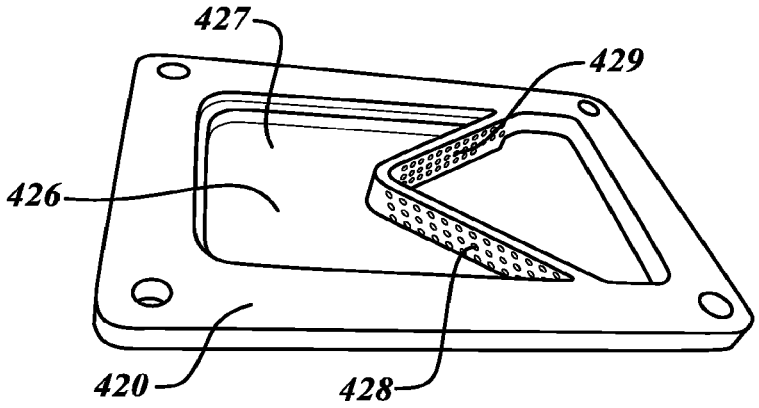
FIG. 4B is a view of an extender for an outlet resonator.

FIG. 4B shows an extender 420 with a lip 428 having perforations 429. Recess 427 can fit onto a supercharger housing. Recess 427 can have a solid wall 426. Wall 426 can be porous, allowing fluid to flow to perforated panels covering recesses, as shown, for example, in FIG. 2.

Guide 401 can be perforated, thereby allowing fluid to pass into first chamber 405, second chamber 406, and third chamber 407 before ultimately exiting through outlet 403. Each chamber can be separated by a layer, for example, layers 410 and 411. Layer 410 separates first chamber 405 from second chamber 406. And layer 411 separates second chamber 406 from third chamber 407.

FIG. 4A shows an outlet resonator assembly 400 with a rectangular housing 408. The housing 408, however, can be pyramidal or other shapes. This allows one to design chambers with different widths, which results in damping different frequencies. Thus, the shape of housing 408 can be selected to damp specific frequencies.

Figure 5:
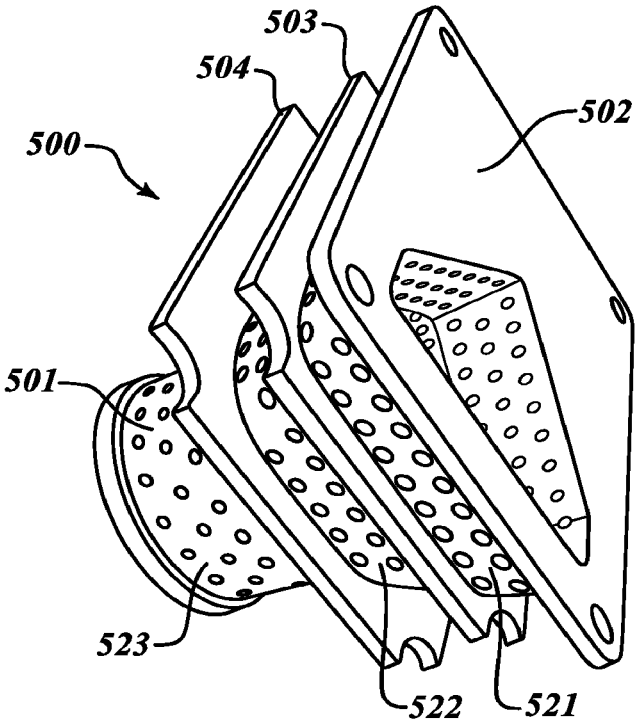
FIG. 5 is a view of a perforated guide with layers dividing the chambers of an outlet resonator.

FIG. 5 shows an outlet resonator assembly 500 without a housing enclosing. FIG. 5 shows an example of perforations in the in guide 501 between the base layer 502 and the first layer 503. Guide 501 also has perforations between first layer 503 and second layer 504.

The perforations can be circular with a diameter less than or equal to 1 millimeter. The openings can be the shape of slits, rectangles, crenelated slots, or other shapes. The cross-sectional area of the openings can be less than or equal to 1 square millimeter. The cross-sectional area can be larger, for example, 4 square millimeters. Changing the cross-sectional area can change the frequency of sound and vibration damped by the arrangement. The openings can comprise different shapes and different areas. This can increase the range of frequency damped by the outlet resonator assembly 500. The perforated guide can have circular openings with a cross-section with a diameter less than or equal to four millimeters. The perforated guide can have circular openings with a diameter less than or equal to five millimeters. The perforated guide can have openings with an area less than or equal to thirteen square millimeters or less than or equal to twenty-five square millimeters.

The entire outlet resonator assembly 500 can be formed into a single piece using three-dimensional printing. Outlet resonator can by formed from multiple sections. For example, base layer 502 can be fixed to a first section 521 of perforated guide. First section 521 can be fixed to first layer 503. Second section 522 can be fixed to both first layer 503 and second layer 504. Third section 523 can be fixed to second layer 504. One can fix the sections and layers together by welding, molding, casting, using adhesives, press-fitting, or using other methods of attachment.

Table 1 includes examples for design configurations of the example shown in FIG. 4A.

TABLE 1

| Chamber | Chamber Height (mm) | Porosity (%) | Hole Diameter (mm) | Number of Holes (approximate) | Layer Thickness (mm) |
|---|---|---|---|---|---|
| Extender (404) | 5.5 | 50 | 3 | 87 | 4 |
| First (405) | 17 | 20 | 3 | 108 | 4 |
| Second (406) | 17 | 12 | 3 | 59 | 4 |
| Third (407) | 34 | 7 | 3 | 60 | 4 |

The configuration is not limited to the parameters in Table 1. For each chamber, the height of the chamber, porosity, hole diameter, and number of holes can be the same, varied, or unique. The thickness of the layers can also be varied or identical. Varying any and all of the parameters above can change the ranges of frequencies damped.

Using a perforated guide with noise dampening chambers in the outlet resonator provides many advantages. For example, a perforated guide can prevent the supercharger air pulsation noise from exciting other intake system components by controlling the supercharger noise at the source. The outlet resonator arrangement also can minimize the necessity expensive component, such as encapsulation and other resonators in the intake system.

The outlet resonator arrangement can also mitigate the necessity of using thick tubing parts to reduce noise. And it can increase supercharger performance by providing a smooth flow mixing process in the outlet area as the perforated guide reduces turbulence and backpressure in the supercharger.

FIG. 6 shows an outlet resonator assembly 600 with a perforated guide 601 and a first chamber 602 separated from a second chamber 603 by first layer 604. Perforated guide 601 can be a single part or a combination of multiple sections connected together.

Attached to first layer 604 is tuning wall 605. The width of second chamber 603 without tuning wall 605 is W1. The width of second chamber 603 with a solid, nonporous tuning wall 605 is W2. When tuning wall does not have perforations 606, tuning wall 605 can create a void 609 between tuning wall 605 and housing 608. The position of tuning wall 603 can be selected based on the desired length of width W2. Changing the width W2 can change the range of frequency damped by second chamber 603. The tuning wall 605 is distanced from the perforated guide 601 to permit resonance of another wavelength in second chamber 603. First chamber 602 can tune one or more noise frequencies, while second chamber 603 can tune different frequencies. Phase cancellation of the selected wavelength permits noise reduction by interfering with the waves as they travel in the chamber.

Figure 6A:
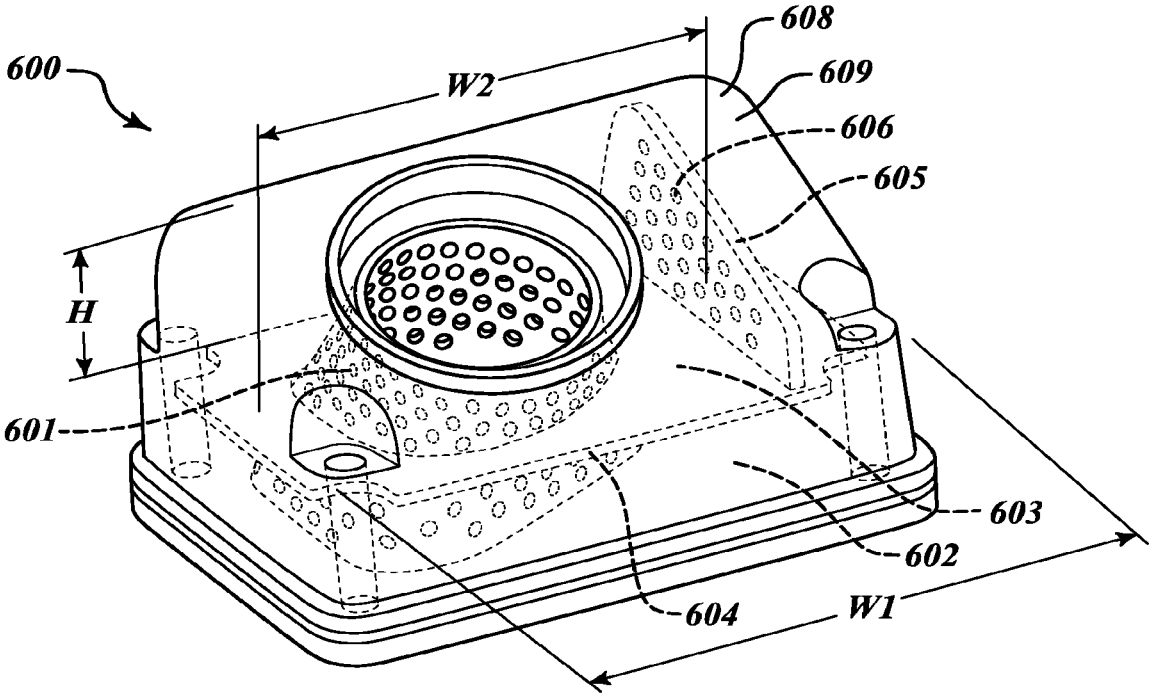
FIG. 6A is a view of an outlet resonator with a tuning wall.

FIG. 6A shows an outlet adapter with only two chambers and one tuning wall. An outlet resonator can include more than two chambers with more than one tuning wall. One can increase the range of frequency damped by adding chambers and tuning walls.

The height H of the second chamber 603 can also be adjusted. Adjusting the height can change amplitude of the damped noise. Likewise, the height of any other chambers can be adjusted to change the amplitude of the damped noise in those chambers.

It is beneficial to damp broadband noise, but conventional resonators are designed to tackle narrow band noise. The outlet resonator assembly 600 in FIG. 6A can damp noise in a wide range of frequency. For example, outlet resonator assembly 600 can damp more than 10 dB of sound for most frequencies between 800 Hz and 2400 Hz when W1 equals 138 mm and W2 equals 38 mm, where first chamber 602 has a width equal to W1. First layer 604 is solid, preventing blow between first chamber 602 and second chamber 603 except through perforated guide 601. First chamber 602 in the arrangement in FIG. 6A can damp frequencies within two ranges, for example, between 800 Hz to 1000 Hz and 1600 Hz to 1800 Hz, where perforated guide 601 has a porosity of 10% with 4 mm diameter holes. Second chamber 603 can also damp frequencies within two ranges, for example between 1000 Hz to 1600 Hz and 1800 Hz to 2400 Hz, where perforated guide 601 has a porosity of 30% with 4 mm diameter holes. Porosity can be calculated using equation (5).

$$P=(A_H \times H_n)/A_G \quad \text{eq. (5)}$$

In equation (1), the variables are defined as follows:

P=Porosity;

$A_H$=Area of Hole;

$H_n$=Number of Holes;

$A_G$=Surface Area of the Section of the Guide in the Respective Chamber Without Holes.

A supercharger assembly can produce unwanted noise in broad range of frequencies. By adjusting the parameters, for example, width, height, and porosity, of the outlet resonator assembly, one can damp frequencies within a single range, for example but not limited to, between 800 Hz and 1600 Hz, 500 Hz and 3000 Hz, or between 1000 Hz and 2000 Hz. A single outlet resonator can also damp frequencies between multiple ranges, for example but not limited to, between 800 Hz and 950 Hz and between 1250 Hz and 1600 Hz. The outlet resonator can be configured to damp more than 10 dB of sound in a frequency range of 800 Hz to 3000 Hz.

When the chamber's volume, sometimes referred to as the resonant volume, is small, the chamber only has one resonant frequency. When the width of the chamber is large, it can have two resonant frequencies, giving it the ability to damp noise in different ranges and in wider ranges.

Tuning wall 605 need not have perforations 606. When tuning wall 605 of outlet resonator assembly 600 does have perforations 606, second chamber 603 acts as a dual Helmholtz resonator. With perforations 606 in tuning wall 605, void 609 is no longer blocked. It can receive air pulsation through perforations 606. Thus, fluid can flow from perforated guide 601 through perforations 606 on tuning wall 605 into into void 609.

The dimensions and volume of void can be selected to damp desired frequencies. Likewise, one can adjust the diameter of perforations 606 and the thickness of tuning wall 605 to damp desired frequencies.

FIG. 6A shows an arrangement where outlet resonator assembly 600 has a first chamber 602 and a second chamber 603. One could eliminate first chamber 602, making a resonator with only second camber 603 with a tuning wall 605 with perforations 606. The resonator need not only be applied to the outlet of a supercharger assembly. The dual Helmholtz arrangement where the resonator has a tuning wall 605 with multiple perforations 606 can be used to damp frequencies at the inlet side of the a supercharger assembly. The dual Helmholtz arrangement with multiple perforations 606 can be used anywhere where one desires to damp noise, vibration, and harshness and is not limited to use with a supercharger assembly.

FIG. 6A shows an outlet resonator assembly 600 using a tuning wall 605 to split second chamber 603, creating a void 609. But one need not use a tuning wall 605 placed inside the chamber. Instead, one could attach a side chamber to a side of second chamber 603 and make perforations between wall separating the side chamber and from second chamber 603.

Figure 8:
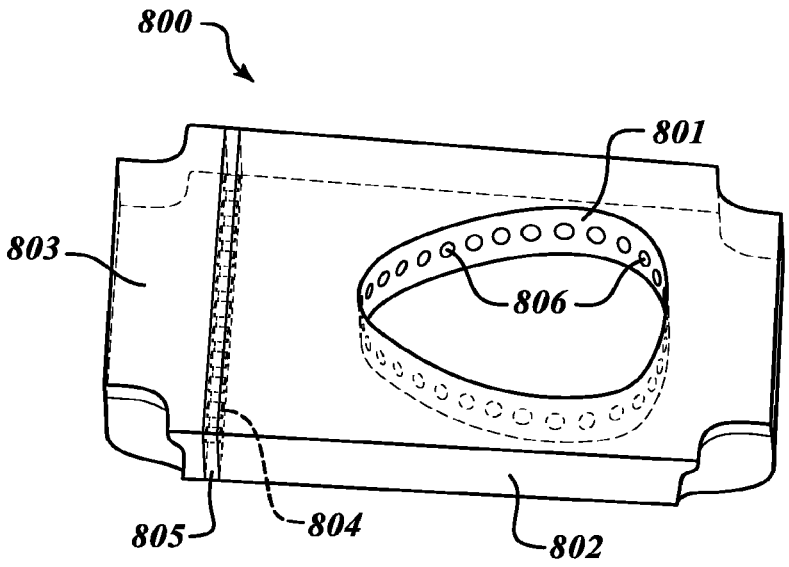
FIG. 8 is a view of dual Helmholtz resonator with a perforated guide.

Using a tuning wall with perforations or a side chamber allows one to damp multiple frequencies in the same main chamber. FIG. 8 shows an example of a resonator 800 with a perforated guide 801 with perforations 806 passing through a single chamber 802 where a side chamber 803 is abuts single chamber 802. Perforations 804 are located in wall 805 that separates single chamber 802 from side chamber 803. Additional chambers can be added below, above, or to the side of single chamber 802. Resonator 800 is not limited to being attached an outlet or to a supercharger housing. Resonator 800 can be used in any arrangement where it is desirable to damp noise, vibration, and harshness.

Figure 6B:
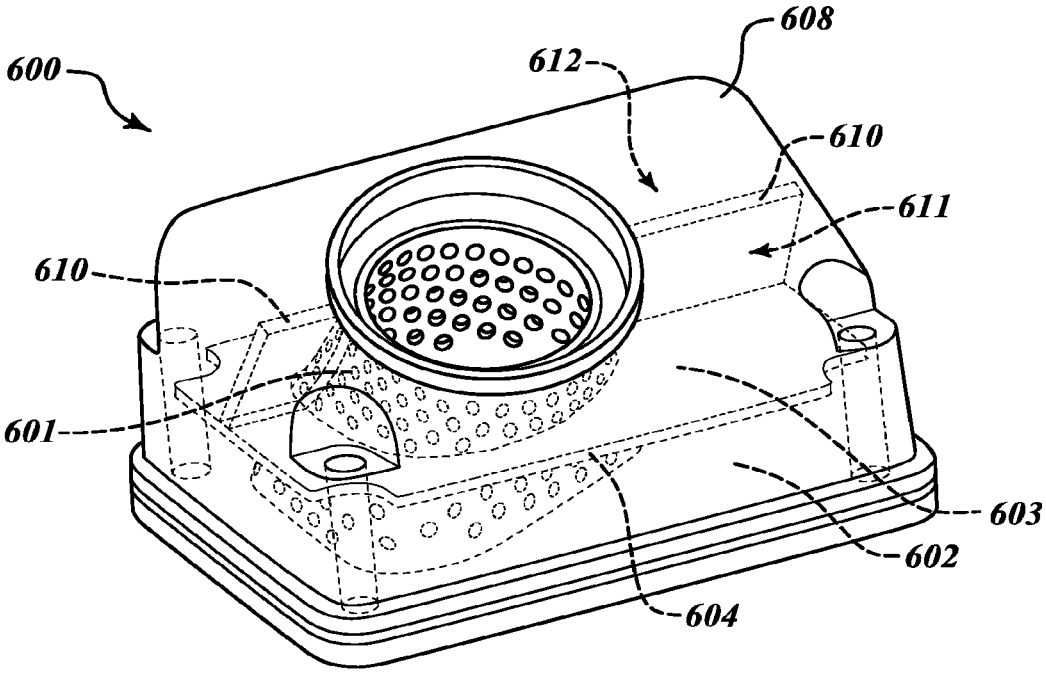
FIG. 6B is a view of an outlet resonator with a split chamber.

FIG. 6B shows an outlet resonator assembly 600 with a wall 610 splitting second chamber 603 into two chambers, creating first split chamber 611 and second split chamber 612. The plane of wall 610 passes through perforated guide 601, but the wall 610 need not pass through perforated guide 601. Perforated guide 601 could have a different porosity or arrangement of perforations on the section of the perforated guide 601 facing first split chamber 611 than the porosity or arrangement of perforations facing second split chamber 612. Wall 610 can be solid to prevent fluid from flowing from first split chamber 611 to second split chamber 612 through wall 610.

Figure 9:
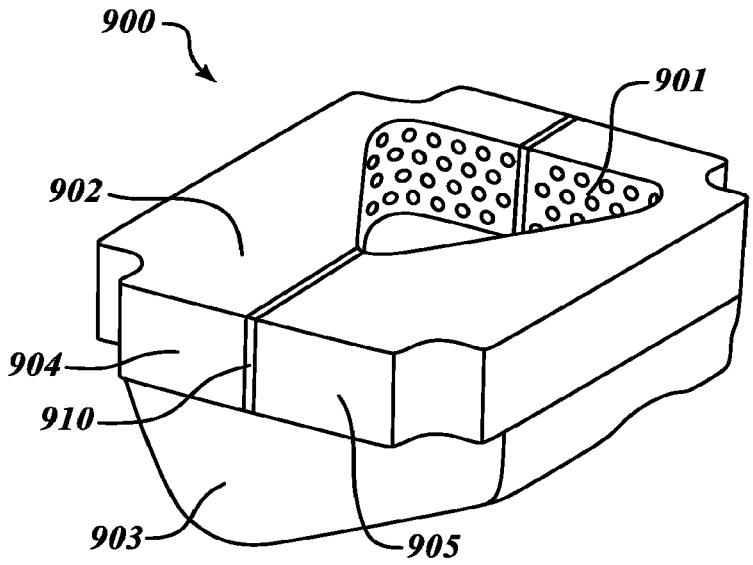
FIG. 9 is a view of an outlet resonator with a split chamber.

FIG. 9 shows another example of an outlet resonator assembly 900 with a perforated guide 901 passing through a first chamber 902 and a second chamber 903. In this arrangement, first chamber 902 is split into a first split chamber 904 and a second split chamber 905. A wall 910 separates first split chamber 904 from second split chamber 905.

A split chamber arrangement with different porosities in a perforated guide gives an outlet resonator the ability to damp different frequencies in the different split chambers. Thus, one can design the split chambers to damp more than one undesirable frequency.

Figure 7:
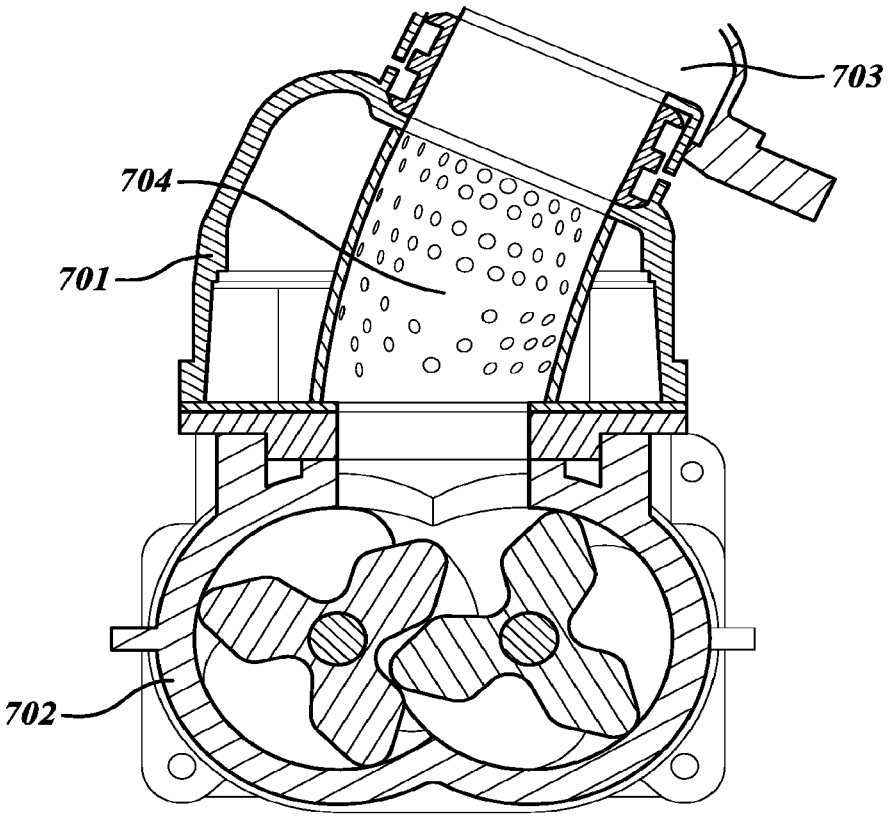
FIG. 7 is a cross-sectional view of an outlet resonator attached to a supercharger.

FIG. 7 shows an outlet resonator 701 attached to a supercharger 702 and an intake manifold 703. As shown, in FIG. 7, perforated guide 704 can flex to fit into intake manifold 703. This configuration permits grazing of airflow while accommodating skewed manifolds. Perforated guide 704 can also be configured to fit an intake conduit rather than attached directly to an intake manifold.

Figure 10A:
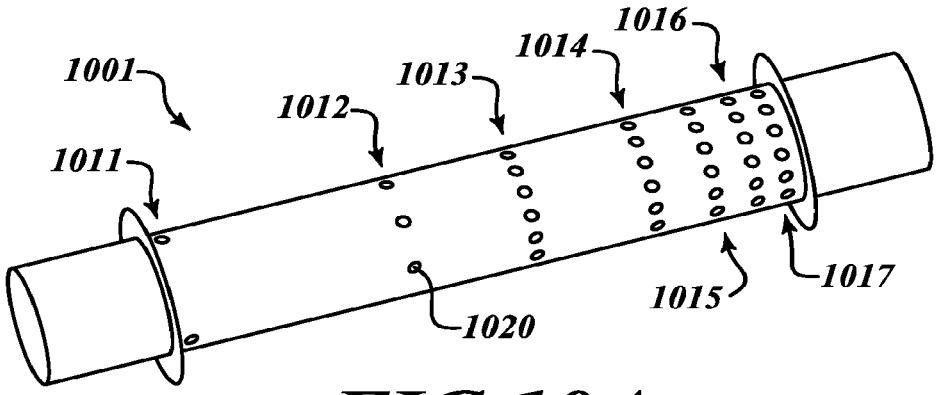
FIGS. 10A-C are views of perforated guides with variable porosity.

FIG. 10A shows a perforated guide 1001 with variable porosity. One can modify the shape of perforated guide 1001 to use it in an outlet resonator, for example, any of the outlet resonators described herein. Perforated guide 1001 of FIG. 10A comprises multiple rows 1011, 1012, 1013, 1014, 1015, 1016, and 1017. The number of holes 1020 can vary in each row. For example, row 1012 has less holes 1020 than row 1017. The spacing between rows can vary. For example, there is more space between row 1012 and row 1013 than between row 1016 and row 1017.

Figure 10B:
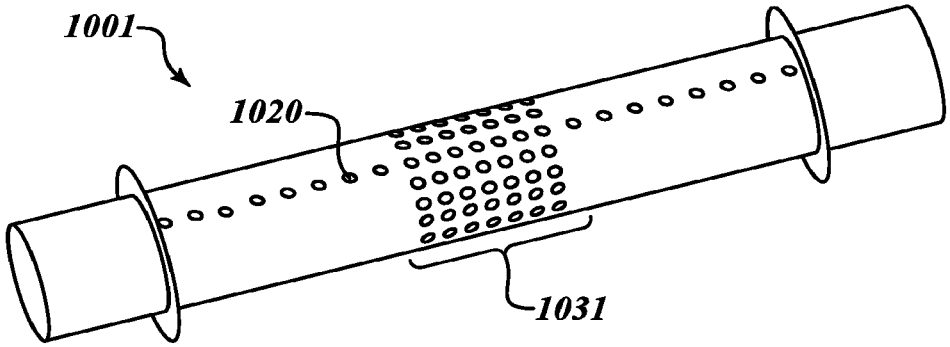
Figure 10C:
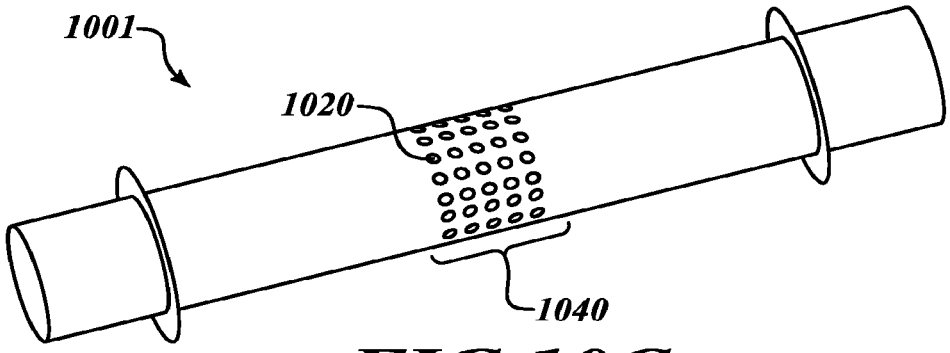

FIG. 10B shows a perforated guide 1001 with rows 1031 having holes 1020 spaced apart radially about perforated guide 1001. Perforated guide 1001 also has holes 1020 spaced apart and aligned axially along perforated guide 1001. The alignment and location of holes 1020 can be arranged in different ways, for example, as shown in FIG. 10C. FIG. 10C shows a perforated guide 1001 with five rows 1040 for radially spaced holes 1020. The number of rows and holes are not limited to the arrangement in FIG. 10C and can be more or less than five.

Figure 11A:
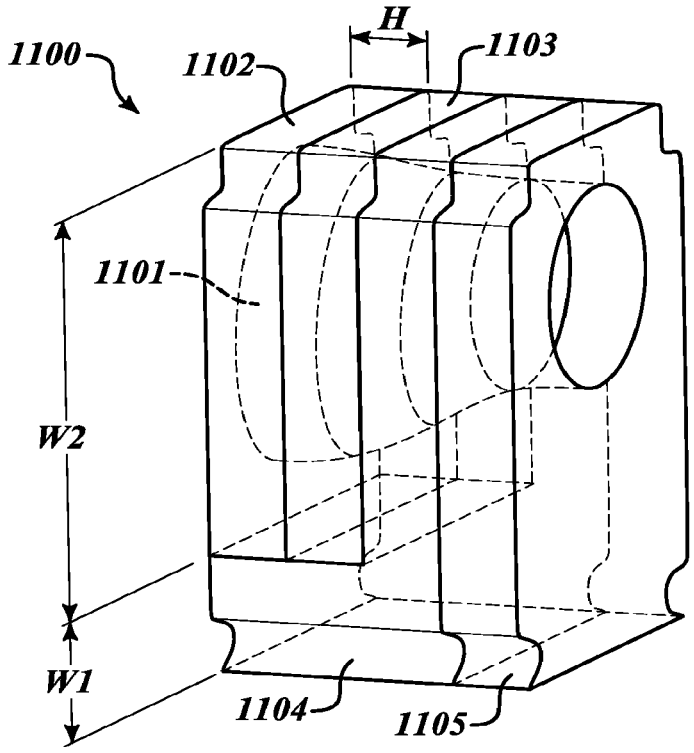
FIGS. 11A-D are views of outlet resonators.

A perforated guide, whether having uniform or variable porosity, can be shaped to fit into any of the outlet resonator assemblies described in this specification. Other outlet resonator assemblies are shown in FIGS. 11A-D. FIG. 11A shows an outlet resonator assembly 1100 with four chambers and a perforated guide 1101. First chamber 1102 and second chamber 1103 have a rectangular cross-section. Third chamber 1104 has an L-shaped cross section and fourth chamber 1105 has rectangular cross-section.

An extender like extender 412 shown in FIG. 4A can be placed adjacent to first chamber 1102. Table 2 sets forth an example of the dimensions of an outlet resonators assembly 1100 shown in FIG. 11A, where W1=32 mm and W2=108 mm and an extender like the extender shown in FIG. 4B has a height of 5.5 mm and with a layer thickness of 4 mm.

TABLE 2

| Chamber | Chamber Height (mm) | Porosity (%) | Hole Diameter (mm) | Layer Thickness (mm) |
|---|---|---|---|---|
| First (1102) | 17 | 30 | 4 | 4 |
| Second (1103) | 17 | 15 | 4 | 4 |
| Third (1104) | 17 | 40 | 4 | 4 |
| Fourth (1105) | 17 | 15 | 4 | 4 |

Figure 11B:
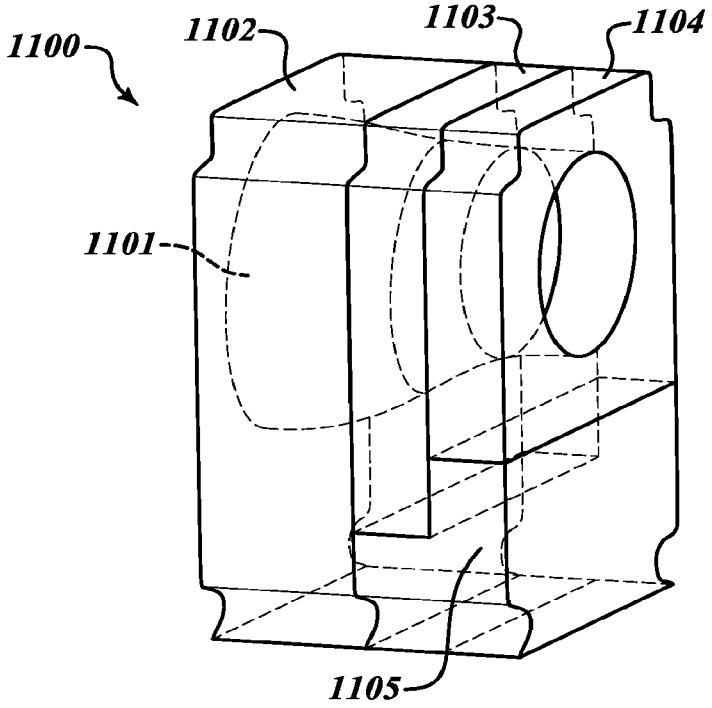

FIG. 11B shows an outlet resonator assembly 1100 with three chambers and a perforated guide 1101. All three chambers 1102, 1103, 1104 have a rectangular cross-section, with each chamber having different dimensions. An L-shaped void 1105 exists below second chamber 1103 and third chamber 1104. Void 1105 can be blocked or it can be in fluid communication with second chamber 1103 or third chamber 1104 or both. Perforations can be located in the walls between void 1105 and second chamber 1103 or third chamber 1104, creating a dual Helmholtz resonator.

Figure 11C:
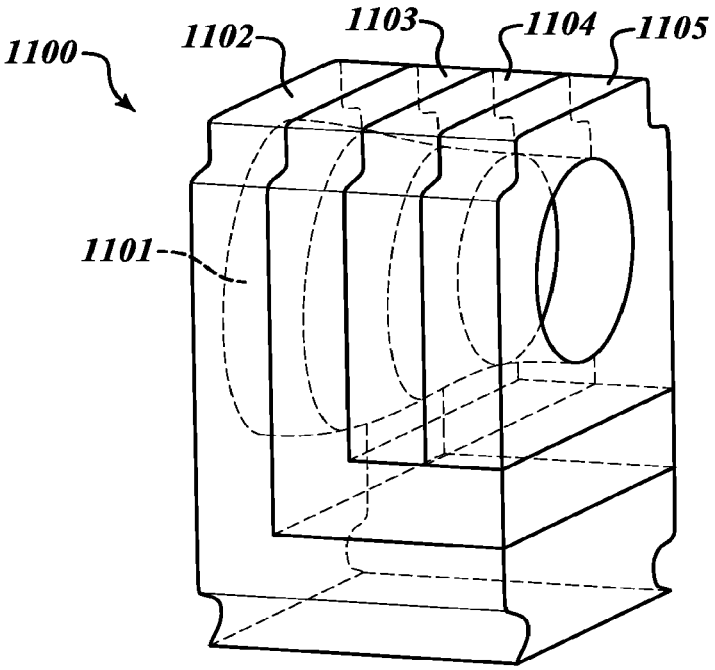
Figure 11D:
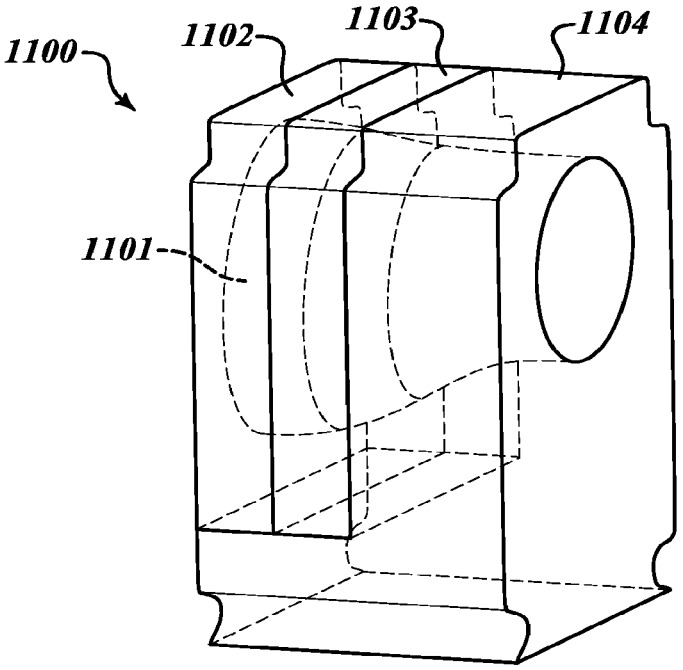

FIG. 11C shows an outlet resonator assembly 1100 with a perforated guide 1101 and four chambers. First chamber 1102 and second chamber 1103 have L-shaped cross-sections, while third chamber 1104 and fourth chamber 1105 have rectangular cross-sections. FIG. 11D shows an outlet resonator assembly 1100 with a perforated guide 1101 and three chambers. First chamber 1102 and second chamber 1103 have a rectangular cross-section. Third chamber 1104 has a L-shaped cross-section. The arrangement of the outlet resonator assembly is not limited to the ones described in the specification. The dimensions and arrangement of the chambers can be modified to dampen different frequency ranges to achieve desired results.

Other implementations will be apparent to those skilled in the art from consideration of the specification and practice of the examples disclosed herein. It is intended that the specification and examples be considered as exemplary only, with the true scope of the invention being indicated by the following claims.

What is claimed is:

1. A supercharger assembly comprising:

a housing;

a rotor bore comprising an outer wall;

an outlet through the outer wall;

an inlet fluidly communicating with the rotor bore;

an outlet divider wall extending from the outlet;

a first recess separated from the outlet by the outlet divider wall;

a spacer abutting the outlet, the spacer having a first spacer recess aligned over the first recess; and a first perforated material covering the first spacer recess and the first recess, wherein the first spacer recess and the first recess are located between the outer wall and the first perforated material.

2. The supercharger assembly of claim 1, further comprising a second recess, wherein the spacer comprises a second spacer recess aligned over the second recess.

3. The supercharger assembly of claim 2, wherein the second recess is separated from the first recess by a portion of the divider wall, wherein the first perforated material covers the second spacer recess and the second recess and wherein the second spacer recess and the second recess are located between the outer wall and the first perforated material.

4. The supercharger assembly of claim 2, wherein a second perforated material covers the second spacer recess and the second recess and wherein the second spacer recess and the second recess are located between the outer wall and the second perforated material.

5. The supercharger assembly of claim 1, wherein the outlet comprises an outlet plane, wherein the spacer abuts the outlet plane.

6. The supercharger assembly of claim 4, wherein the outlet comprises an outlet plane, wherein the spacer abuts the outlet plane, and wherein the spacer receives the first perforated material and the second perforated material.

7. The supercharger assembly of claim 1, wherein first perforated material is seated on a step on the spacer.

8. The supercharger assembly of claim 1, wherein the first perforated material is positioned a distance away from the outer wall to dampen vibrations or sound.

9. The supercharger assembly of claim 1, wherein a first porous material is located in the first recess between the outer wall and the first perforated material.

10. The supercharger assembly of claim 9, wherein the first porous material comprises at least one of the following materials: melamine foam, fiberglass, mineral glue, BASOTECT® open cell foam by BASF: The Chemical Company, melamine resin, thermoset polymer, or NOMEX® flame resistant fiber by DuPont.

11. The supercharger assembly of claim 1, wherein the first perforated material is a micro-perforated material, wherein the micro-perforated material comprises openings with a cross-section having an area of less than 1 square millimeter.

12. The supercharger assembly of claim 1, wherein the first perforated material comprises openings with a cross-section having an area greater than or equal to two square millimeters and less than or equal to four square millimeters.

13. The supercharger assembly of claim 1, wherein the first perforated material comprises circular openings and wherein at least one opening has a diameter of less than two millimeters.

14. The supercharger assembly of claim 1, wherein the first perforated material comprises openings in the shape of slits, rectangles, or crenelated slots.

15. The supercharger assembly of claim 1, wherein the first perforated material damps sound when air pulsations move through the perforated material.

16. The supercharger assembly of any one of claim 1, wherein the first recess damps sound when air pulsation moves in the recess.

17. The supercharger assembly of claim 1, wherein the outlet is in an outlet plane of the outer wall, and wherein the inlet is in an inlet plane perpendicular to the outlet plane.

18. The supercharger assembly of claim 1, further comprising an extender comprising a perforated lip, the spacer connected between the extender and the outlet.

19. An outlet resonator for a supercharger assembly, comprising:

a spacer connected to a supercharger outlet comprising a divider wall separating the outlet from a first spacer recess and a second spacer recess;

a first perforated material covering the first spacer recess; and a second perforated material covering the second spacer recess.

20. The outlet resonator for a supercharger assembly of claim 19, further comprising a first porous material in the first spacer recess and a second porous material in the second spacer recess.

* * * * *